United States Patent [19]

Bailey

[11] 4,292,940

[45] Oct. 6, 1981

[54] APPARATUS FOR CONTROLLING THE QUANTITY OF FUEL DELIVERY TO AN ENGINE AND ENGINE TIMING

[75] Inventor: John M. Bailey, Dunlap, Ill.

[73] Assignee: Caterpillar Tractor Co., Peoria, Ill.

[21] Appl. No.: 99,140

[22] PCT Filed: Aug. 27, 1979

[86] PCT No.: PCT/US79/00657

§ 371 Date: Aug. 27, 1979

§ 102(e) Date: Aug. 27, 1979

[51] Int. Cl.[3] ..... F02D 7/00

[52] U.S. Cl. ..... 123/387; 123/501; 123/369

[58] Field of Search ..... 123/387, 385, 388, 379, 123/369, 501, 380, 364, 365

[56] References Cited

U.S. PATENT DOCUMENTS

| | | | |
|---|---|---|---|
| 3,119,381 | 1/1964 | Cummins, Jr. | 123/364 |
| 3,485,223 | 12/1969 | Kaibara et al. | 123/363 |
| 3,814,072 | 6/1974 | Gillespie | 123/351 |
| 3,968,779 | 7/1976 | Davis | 123/382 |
| 3,991,732 | 11/1971 | Dreisin | 123/374 |
| 4,052,971 | 10/1977 | Salzgeber et al. | 123/504 |
| 4,054,112 | 10/1977 | Kurokawa et al. | 123/382 |

*Primary Examiner*—Ira S. Lazarus
*Assistant Examiner*—Magdalen Moy
*Attorney, Agent, or Firm*—Phillips, Moore, Weissenberger, Lempio & Majestic

[57] ABSTRACT

The invention pertains to apparatus for controlling the quantity of fuel delivery to an engine and engine timing. Several problems with prior apparatus include their high cost and inability to be easily programmed for control purposes, together with their use of complicated electrical controls to meet reliability standards. The inventive solution includes a control rod (16) having a plurality (25,84) of control surfaces of preset shape that determine the maximum quantity of fuel delivery to the engine and engine timing A plurality (30–36, 40,70) of hydromechanical control circuits axially and rotatably move the control rod (16) in response to engine speed and load. A plurality (18,26,28 and 90–100, 100') of devices control the maximum quantity of fuel delivery and engine timing based on the axial and rotatable positions of the rod (16). The inventive apparatus is used principally to control exhaust emissions from an engine.

17 Claims, 7 Drawing Figures

APPARATUS FOR CONTROLLING THE QUANTITY OF FUEL DELIVERY TO AN ENGINE AND ENGINE TIMING

DESCRIPTION

1. Technical Field

This invention relates to an apparatus for controlling the amount or quantity of fuel delivery to an engine and engine timing in response to engine operating conditions and, more particularly, to apparatus for controlling exhaust emissions from the engine.

2. Background Art

In recent years, emphasis has been placed on the control of exhaust gaseous emissions and smoke from vehicle engines to reduce air pollution. Typically, the pollutants are reduced by adjusting engine timing and/or the fuel-air ratio delivered to the engine. As pollution requirements become more and more stringent, more exact control of both engine timing and the airfuel ratio will be required to meet these standards.

In a diesel engine having a fuel injection system in which fuel is delivered by a fuel pump to a fuel injector, it is desirable, for example, to inject 100 percent more fuel per pump stroke when cranking the engine than at rated output to achieve satisfactory start-up. It is also necessary to inject substantially less fuel per stroke than at rated output during engine speeds between low idle and peak torque to prevent excessive smoke. Similar reductions in fuel injected into the engine are required at high altitude, or for turbocharged engines at low speeds when they operate essentially naturally aspirated to reduce emissions. Thus, the maximum fuel injected into the engine should vary accurately in response to engine speed, ambient conditions and even lug. Furthermore, engine tests indicate that gaseous emissions can be minimized if injection timing is optimized for each engine speed-load operating condition.

In view of these stringent pollution requirements and the various engine and ambient conditions which should be considered for purposes of engine control, a problem exists in providing a satisfactory system for pollution control. This is because such a system should control both quantity or amount of fuel delivery and injection timing in response to various engine operating conditions, and be relatively easy to program and inexpensive for commercial purposes. Furthermore, the system should be reliable in terms of pollution control and yet be simple for easy and inexpensive repair in the event of breakdown. Still further, it would be desirable to operate the control system hydro-mechanically and take advantage of existing fluids used for the diesel vehicle, rather than utilizing electrical power sources for control purposes. The prior art does not have these attributes.

DISCLOSURE OF INVENTION

The present invention is directed to overcoming one or more of the problems as set forth above.

According to the present invention, there is provided apparatus for controlling the quantity of fuel delivery to an engine in response to engine operating conditions, including first means for controlling the quantity of fuel delivery to the engine in response to engine load, and second means for controlling the quantity of fuel delivery to the engine in response to engine speed.

One problem with the prior art is that no system exists for controlling fuel delivery quantity and injection timing in response to various engine operating conditions. This and other problems of the prior devices are solved by the above-mentioned apparatus of the invention. Advantages of this invention include reliable pollution control and an apparatus which is easy and inexpensive to program.

BEST MODE FOR CARRYING OUT THE INVENTION

Figure 1:
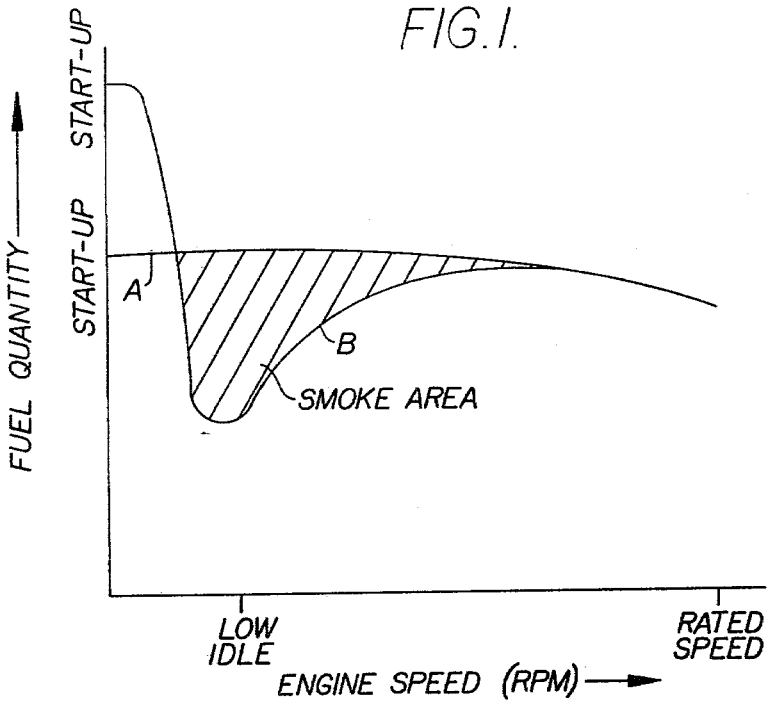
FIG. 1 is a graph illustrating the fuel quantity delivered to a diesel engine in relation to engine speed.

In FIG. 1 there is shown two curves A and B, the former representing fuel quantity delivered to a diesel engine as a function of engine speed with prior devices, and the latter representing fuel quantity delivered as a function of engine speed with the control system of the present invention. At engine start-up for both curves A and B, the quantity of fuel delivered is greater than at the rated speed. In the range of low idle speed, the amount of fuel delivered to the engine in accordance with curve A will produce smoke in the engine exhaust since this amount is about equal to the amount delivered at rated speed. With the present invention, in accordance with curve B, there is a substantial reduction in fuel quantity delivered to the engine in respect to rated speed in the range of low idle up to peak torque, resulting in a minimization of exhaust smoke. For example, excessive smoke will be eliminated if the present invention is programmed to control the quantity of fuel injected in this speed range to be 50–75 percent of the fuel injected at rated speed.

Figure 2:
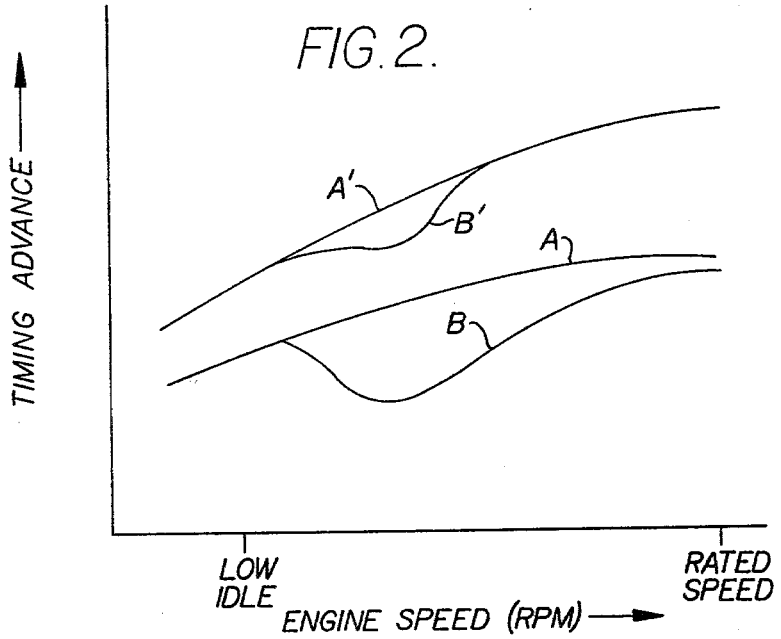
FIG. 2 is a graph illustrating the timing advance for a fuel injector in relation to engine speed.

FIG. 2 illustrates two groups of curves corresponding, respectively, to the timing advance as a function of engine speed for both no load and full load conditions. Under a no load condition, curve A represents the timing advance provided by prior devices, while curve B represents the desired curve provided by the present invention for reducing pollutants. Similarly, under full load conditions, curve A′ represents the timing advance for such prior devices, while curve B′ represents the desired curve provided by the present invention to minimize pollutants.

Figure 3:
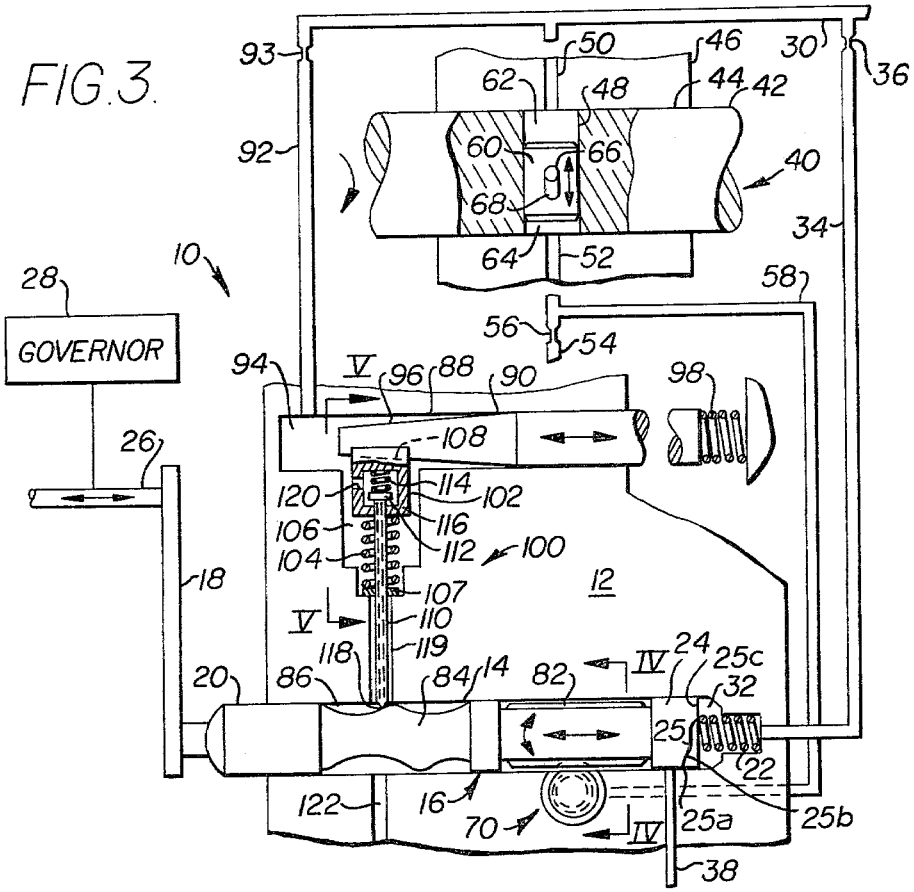
FIG. 3 is a side view, partly in section, of an embodiment of the present invention for controlling fuel delivery and injection timing.

FIG. 3 illustrates, schematically, a hydromechanical system for controlling fuel injection timing and quantity of fuel delivery in a predetermined manner in response to various engine operating conditions, particularly engine load and engine speed. The system 10 includes a housing 12 having a bore 14. A control rod 16 is arranged to reciprocate axially and to rotate through a desired angle within bore 14. A lever 18, which is axially reciprocal, is in contact with one end 20 of rod 16 to move the rod to the right as viewed in FIG. 3 against the force of a spring 22 connected to the other end 24 of the rod. The end 24 of the rod 16 has a scroll or curved control surface 25 of predetermined shape which provides the rod 16 with different aixal lengths, the significance of which will be described below. Spring 22 functions to push rod 16 to the left as viewed in FIG. 3 to maintain contact between lever 18 and rod end 20.

A fuel rack shown generally at 26, well known in the art, is connected at one end to the lever 18 and at its other end to a fuel pump (not shown) which delivers fuel to a fuel injector (not shown). Fuel rack 26 is mounted for axial reciprocation, as indicated in FIG. 3, to control the amount of fuel delivered by the fuel pump, depending on the axial position of the rack. A governor 28, also well known in the art, is connected to the rack 26 to change the axial position of the rack 26 in response to engine load. As, for example, the engine load increases, the governor will call for more fuel by moving rack 26 to the right as shown in FIG. 3, thereby increasing the fuel pump output. As a result, lever 18 will move to the right to shift rod 16 to the right against the force of spring 22. Should the engine load decrease, governor 28 will call for less fuel, thereby moving rack 26 to the left to reduce the fuel pump output; thus, lever 18 will move to the left, allowing spring 22 to move rod 16 to the left in contact with lever 18. Consequently, it will be appreciated that rod 16 reciprocates within bore 14 as a function of or in response to engine load.

A control fluid supply manifold 30 delivers fluid into an end chamber 32 of bore 14 through a fluid passage 34 having a flow limiting orifice 36. A fluid passage 38 is opened and closed by the end 24 of rod 16, particularly scroll 25, to receive the control fluid within chamber 32. As this control fluid from passage 34 enters chamber 32, it can keep rod 16 from moving to the right under the force of governor 28 tending to move the rod 16 to the right. The control fluid in manifold 30 is diesel fuel, which is drawn from a supply tank (not shown), and returned to the tank via passage 38. Actually, during operation, passage 38 is never fully closed because pressure builds up in chamber 32 which acts as a fluid stop.

A hydraulic engine speed sensing system shown generally at 40 intermittently rotates the control rod 16 as a function of or in response to engine speed. System 40 icludes a shaft 42 which is mounted for rotation within a bore 44 of a housing 46. Shaft 42 rotates in response to engine speed, by, for example, coupling it to the engine drive shaft (not shown). Shaft 42 has a cross-bore 48 which communicates at oneend with a fluid passage 50 receiving control fluid from the manifold 30. Another passage 52 is in communication with the bore 48 opposite the passage 50 to receive the control fluid entering bore 48 via passage 50. Passage 52 delivers the fluid to a passage 54 through a flow limiting orifice 56 for return to the supply tank (not shown). Upstream of the orifice 56, the fluid flow through the passage 52 provides a pressure signal through a passage 58.

A shuttle piston 60 is mounted for axial reciprocation within bore 48 as shaft 42 rotates and defines two bore chambers 62 and 64. A cross-pin 66 is connected to shaft 42 and extends through an elongated slot 68 in piston 60 to limit the stroke of this piston.

Figure 4:
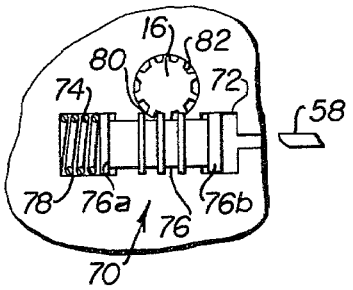
FIG. 4 is a view taken along lines 4—4 of FIG. 3.

As shown in FIGS. 3 and 4, the passage 58 delivers the pressure signal created by the flow down the passage 52 to a piston-cylinder arrangement 70 which causes rotation of the control rod 16 within bore 14. The arrangement 70 includes two cylinders 72 and 74, which slidably support either end **76*a* and 76*b* of a piston 76. A spring 78 is disposed within cylinder 74 and the end 76*a* of piston 76 to bias the latter to the right as viewed in FIG. 4, or inwardly as viewed in FIG. 3. The pressure signal in passage 58 enters cylinder 72 to act on end 76*b*, causing piston 76 to slide to the left, as viewed in FIG. 4, against the force of spring 78. Piston 76 has circumferential splines 80 which engage with similar circumferential and axially elongated splines 82 on control rod 16. With this mating arrangement between splines 80 and 82, the movement of piston 76 either left or right as viewed in FIG. 4 will cause rotation of the rod 16 in either a clockwise or counterclockwise direction; yet, rod 16 will be able to move axially in either direction as shown in FIG. 3**.

The hydraulic speed sensing system 40 rotates the control rod 16 in response to engine speed in the following manner. Control fluid from supply manifold 30, which fluid can be essentially at a constant pressure, is directed through passage 50 to engage intermittently cross-bore 48 located within shaft 42 which, as already noted, rotates in response to engine speed. As shaft 42 rotates, one chamber 62 or 64 of the bore 48 will register with inlet passage 50 and, at the same time, the other chamber 62 or 64 will register with output passage 52. The effect is an intermittent axial movement of the shuttle piston 60 forced by the supply pressure from passage 50 and limited to constant strokes by pin 66 and slot 68. When chamber 62 receives fluid from passage 50, the fluid in chamber 64 is forced into passage 52 by piston 60. In the next ½ revolution of shaft 42, chamber 64 receives fluid from passage 50 and piston 60 forces the fluid in chamber 62 into passage 52. Thus, for each rotation of the shaft 42, two equal volumes of control fluid will pass from inlet passage 50 to outlet passage 52.

From the above operation of piston 60 within bore 48, it will be seen that the volume flow of control fluid per unit time in the passage 52 will have a direct relation to the rotation of shaft 42 per unit time. This volume flow, which is forced through orifice 56, will create a pressure P which varies as a function of the square of the rotation of the shaft 42 and, hence, engine speed N ($P \sim N^2$). This variable pressure acts via passage 58 on piston 76 to move the latter axially as viewed in FIG. 4; therefore, control rod 16 will rotate partially and this rotation is proportional to the square of engine speed ($N^2$). If desired, this rotational or angular movement of the control rod 16 can be made linear with change in engine speed by the use of a variable rate spring for spring 78 in conjunction with piston 76.

Control rod 16 also is used to vary injection timing in a prescribed manner in response to both engine speed and load. To do this, the rod 16 has another control surface or "cam" section 84 which defines a chamber 86 in bore 14, as shown in FIG. 3. Surface 84 is three dimensional and serves as a mechanical "memory" or "program" whose various axial positions corresponding to engine load and whose various angular positions corresponding to engine speed are used to effect or change the injection timing.

Figure 5:
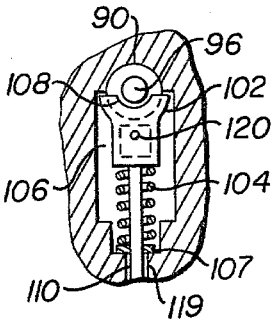
FIG. 5 is a view taken along lines 5—5 of FIG. 3.

As shown in FIGS. 3 and 5, housing 12 includes another bore 88 in which is axially slidable an engine timing piston 90. A passage 92 including a flow limiting orifice 93 communicates control fluid from manifold 30 with a chamber 94 in bore 88 defined by a tapered section 96 of piston 90. The fluid within chamber 94 acts on the tapered section 96 against a spring 98 to move the piston 90 to the right as viewed in FIG. 3. The piston 90 is coupled to a fuel pump timing control (not shown) by means (not shown) to automatically change the engine timing in dependence on the axial position of piston 90 within bore 88.

A cam follower servo mechanism 100 for cam section or control surface 84 includes a member 102 which is biased by a spring 104 to keep the member 102 always in contact with the tapered section 96 of piston 90. The spring 104 is disposed within a chamber 106 between a fluid seal 107 in housing 12 and the bottom of member 102. Member 102 has a curved upper surface 108 so that piston 90 can slide smoothly and axially relative to the surface 108. A hollow cylindrical stylus 110 has its upper end 112 slidably fitted within member 102 and is lightly loaded by a spring 114 disposed between member 102 and the upper end 112 to bias the latter onto a shoulder 116 in member 102.

Stylus 110 extends within a bore 119 of housing 12 from upper end 112 to a lower end 118 which is located within chamber 86 near the control surface 84, with both the upper end 112 and lower end 118 being open to transfer control fluid from chamber 94 within bore 88 to chamber 86 within bore 14. The stylus 110 receives the fluid through a passage 120 within member 102 while chamber 86 is in communication with another passage 122 to transfer the fluid within chamber 86 to the supply tank (not shown). Consequently, a fluid path exists from supply manifold 30, through orifice 93 and passage 92, into chamber 94 and then chamber 106, and then through passage 120, down stylus 110 into chamber 86 and out passage 122. Seal 107 seals the chamber 106 from bore 119.

Figure 6:
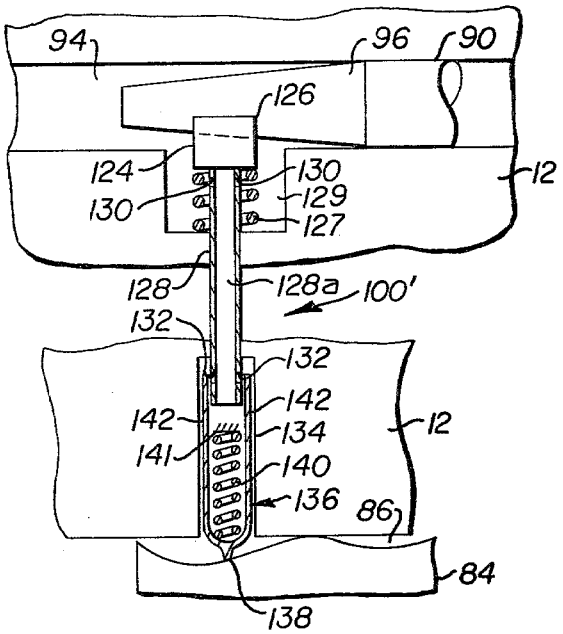
FIG. 6 is an enlarged view of an alternative embodiment of part of the system shown in FIG. 3.

FIG. 6 illustrates an alternative embodiment to the cam follower servo mechanism 100 shown in FIGS. 3 and 5. Like reference numerals are used to show the same elements used in FIGS. 3 and 6. The alternative servo mechanism 100' includes a member 124 having a curved upper surface 126 similar to surface 108, which is spring biased by a spring 127, disposed in a chamber 129, to remain always in contact with tapered section 96 of piston 90. Member 124 has a depending hollow cylindrical rod 128 having upper fluid communication passages 130 communicating the chamber 129 with the interior **128*a* of the rod 128, and lower fluid communication passages 132 within a chamber 134 which is open to chamber 86 of bore 14. A stylus 136 has a rounded end 138 which is spring biased by a spring 140, disposed between a fixed member 141 and stylus 136, into contact at all times with the control surface 84. Stylus 136 is slidable within chamber 134 and has two legs 142 which, at their upper ends, open and close the passages 132 by sliding relative to rod 128. Consequently, when passages 132 are at least partially open, a fluid path will be made from chambers 94 and 129, through passages 130, down the interior 128*a* of stylus 128, out passages 132, and into chamber 134 and chamber 86**.

Figure 7:
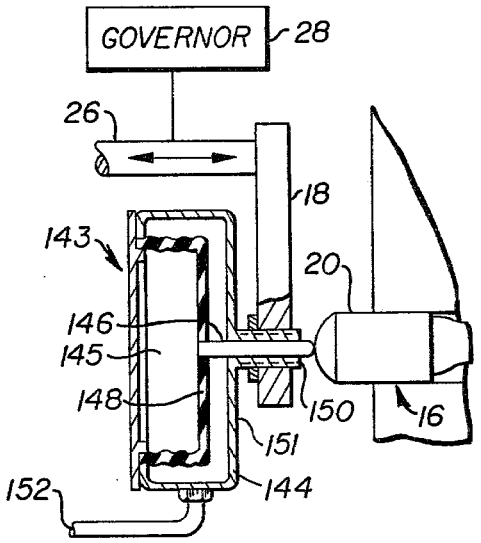
FIG. 7 is an enlarged view of an alternative embodiment of another part of the system shown in FIG. 3.

In addition to controlling the maximum quantity of fuel delivery and injection timing in response to engine load and engine speed, the system 10 shown in FIG. 3 can be modified to control the quantity of fuel delivery in response to, for example, altitude or boost for a turbocharged engine. FIG. 7 illustrates a control device 143 which can be added to the system 10 for performing this function. Device 143 includes a container 144, and a hermetically sealed bellows 145 which has a rod 146 that is fixedly connected to one movable end 148 of the bellows 145 and slidable through the hollow center of another relatively stationary screw 150. Rod 146 extends through screw 150 to engage the end 20 of rod 16. Screw 150 is connected to the end 151 of container 144 and is threadably engaged to lever 18. A flexible tube 152 couples the interior of container 144 with, for example, the intake manifold (not shown) of the vehicle engine. Pressure within container 144 will change with the inlet manifold pressure due to altitude changes and due to action of a supercharger if the engine is so provided.

INDUSTRIAL APPLICABILITY

There will now be described the way in which the above-described axial and rotational movements of the control rod 16 are used to control the quantity of fuel delivery to the injector (not shown) of an engine. The quantity of fuel delivery is the quantity of fuel per engine revolution. Control fluid, which can be fuel at a moderate 30–60 psi, but essentially constant pressure, is drawn from manifold 30 and through orifice 36, passage 34 and into chamber 32 at the end of bore 14. If, for example, the governor 28 is calling for maximum fuel delivery, such as during maximum load, rack 26 will want to move fully to the right as shown in FIG. 3, together with lever 18 and control rod 16, to control the fluid pump (not shown) to deliver maximum fuel. However, the flow entering chamber 32 builds up a pressure which acts on the end 24 to keep control rod 16 and hence lever 18 and rack 26 from moving fully to the right. At this time the end 24, particularly scroll 25, of rod 16 covers passage 38. Then, as pressure builds up in chamber 32 the rod 16 moves to the left, overcoming the force provided by governor 28, until the passage 38 is slightly opened.

Because end 24 has the scroll or control surface 25 of predetermined shape which provides different axial lengths for rod 16, the axial position of the rod 16 at the point of opening chamber 32 to passage 38 will depend on the angular position of the rod which, as already described, relaes to engine speed. For example, with rod 16 in the rotatable position shown with an area **25*a* of scroll 25 controlling the opening of passage 38, such axial position of rod 16 will be different than if rod 16 were rotated such that area 25*b* or area 25*c* controlled the opening of passage 38. More particularly, if the engine speed were such that area 25*c* were in the position shown for area 25*a*, then the rod 16 will be moved further to the left by the pressure buildup in chamber 32 to open slightly passage 38, than if area 25*a*** were so positioned. Thus, the maximum quantity of fuel delivery is controlled automatically in response to engine load and engine speed.

In the operation of automatically controlling engine timing in response to engine load and speed, since stylus 110 at its lower end 118 is in very close proximity to the surface 84 of rod 16, there will be a certain fluid pressure on the surface 84. This fluid pressure on surface 84 will cause a buildup in the fluid pressure acting in chamber 94 against the tapered section 96 of piston 90. This fluid pressure in chamber 94 will push piston 90 to the right overcoming the force of spring 98 and, thereby, changing the axial position of piston 90 within bore 88. As this movement to the right occurs, spring 104 will move member 102 upwardly to maintain the member 102 in contact with tapered section 96; hence, stylus 110 also will rise with member 102 due to its seating on shoulder 116 by spring 114, thereby increasing the distance between the bottom 118 of stylus 110 and the control surface 84. This upward movement of stylus 110 increases the distance between the bottom 118 and control surface 84, thereby reducing the pressure within chamber 94 until equilibrium exists between the force on section 96 moving piston 90 to the right and the force exerted by spring 98 moving piston 90 to the left.

When these pressures provided by fluid to chamber 94 and spring 98 are equalized, the piston 90 will have obtained a new axial position resulting in a specific timing in which fuel is introduced through the fuel injector into the engine. The action of piston 90, i.e., its axial movement to such equalization position, is initiated and controlled by changes in the proximity of stylus 110 at its lower end 118 to the control surface 84. This proximity relationship is dependent on the axial and rotatable position of surface 84 in accordance with the above-described movement of control rod 16. Consequently, it will be seen that engine timing is adjusted in response to engine load due to the axial displacement of the rod 16 and engine speed due to the rotational position of rod 16. It also will be appreciated that the actual timing changes will, of course, be dictated by the particular preselected contours for surface 84 which, is already noted, constitutes a memory or program.

The function of servo mechanism 100' is similar to the servo mechanism 100 in that it produces pressure changes in chamber 94 until an equalization pressure is reached, at which point piston 90 will be in a new axial position to automatically change engine timing in response to engine load and engine speed. When control rod 16 is moved to a new axial and rotatable position, rounded end 138 will follow the contour of surface 84 to open or close passages 132 by an amount depending on the surface 84. As passages 132 are, for example, being closed, there will be a pressure buildup in chamber 94 moving piston 90 to the right and, thereby, enabling spring 127 to move member 124 upwardly into contact with tapered segment 96. This upward movement of member 124 will thus cause passages 132 to open again. The axial movement of piston 90 will continue until passages 132 are open to transfer fluid down chamber 134 into chamber 86 and out passage 122 such that an equalization pressure is reached between the force on section 96 and that produced by spring 127.

The embodiment of FIG. 7 operates in the following manner. As the inlet manifold pressure increases or altitude decreases, the pressure inside container 144 will increase to, for example, move end 148 of the hermetically sealed bellows to the left, as viewed in FIG. 7, with respect to the end 151. Consequently, rod 146 will seal slidably through screw 150 to the left away from contact with rod 16. The governor 28 can now move the rack 26 and lever 18 to the right. This will carry the entire control device 143 to the right until screw 146 once again contacts rod 16, whereby more fuel can be called for.

In practice, the scroll 25 and the three dimensional surface 84 will be machined relative to a common angular mark on control rod 16 and with closely held axial dimensions. The spring 78 used with piston 76 would be adjusted to locate this mark in a predetermined angular location for a given engine speed. The quantity of fuel delivery for this given speed would then be calibrated by making rod 146 extend a predetermined distance from screw 150 for the FIG. 7 embodiment, or by appropriately calibrating rack 26, if the device 143 were not used, for the FIG. 3 embodiment. Injection timing would be adjusted at a selected engine speed and load by a dimensional adjustment (not shown) provided by the coupling between the piston 90 and the fuel pump timing control (not shown).

Other aspects, objects and advantages of this invention can be obtained from a study of the drawings, the disclosure and the appended claims.

I claim:

1. Apparatus (10) for controlling the quantity of fuel delivery to an engine in response to engine operating conditions, comprising:

(a) first means (16, 22, 32, 34, 38) for controlling the maximum quantity of fuel delivery to the engine in response to engine load;

(b) second means (16, 40, 70) for controlling the maximum quantity of fuel delivery to the engine in response to engine speed; and (c) wherein said first controlling means (16, 22, 32, 34, 38) and said second controlling means (16, 40, 70) include a control rod (16) having a control surface (25) of predetermined shape defining various axial rod lengths, said control rod (16) being rotatable to any one of a plurality of positions in response to engine speed and being axially movable in response to engine load and in dependence on the rotatable position of said control rod (16).

2. Apparatus (10) according to claim 1 wherein said second controlling means (16, 40, 70) includes means (40, 70) for rotating said control rod (16).

3. Apparatus (10) according to claim 2 wherein said means (40, 70) for rotating includes:

(a) means (40) for sensing engine speed and generating a control signal in response thereto; and (b) means (70) for moving said control rod (16) in response to the control signal.

4. Apparatus (10) according to claim 1 wherein said first controlling means (16, 22, 32, 34, 38) further includes means (16, 90, 94, 96, 98, 100) for regulating the timing of the engine.

5. Apparatus (10) according to claim 4 wherein said means (16, 90, 94, 96, 98, 100) for regulating includes means (16) for changing the engine timing in response to engine speed and load.

6. Apparatus (10) according to claim 5 wherein said means (16) for changing includes said control rod (16) having another control surface (84) of predetermined shape whose axial and rotatable positions correspond to engine load and speed.

7. Apparatus (10) for controlling exhaust emissions from an engine, comprising:

(a) means (16) for automatically and preselectively controlling the maximum quantity of fuel delivery to the engine in response to engine load and speed, including a control rod (16) having a control surface (25) of predetermined shape defining various axial rod lengths, said control rod (16) being rotatable to any one of a plurality of positions in response to engine speed and being axially movable in response to engine load and in dependence on the rotatable position of said control rod (16);

(b) means (40) for sensing engine speed and generating a control signal in response thereto;

(c) means (70) for rotating said control rod (16) in response to the control signal; and (d) means (32, 34, 38) for axially moving said control rod (16) a predetermined length in dependence on the rotatable position of said control rod (16).

8. Apparatus (10) according to claim 7 further including means (16, 90, 96, 98, 100) for changing engine timing in response to engine load and speed.

9. Apparatus (10) according to claim 8 wherein said means (16, 90, 96, 98, 100) for changing includes:

(a) said control rod (16) having another control surface (84) of predetermined shape whose axial and rotatable positions correspond to engine load and speed; and (b) means (90, 96, 98, 100) for regulating the engine timing and being operatively associated with said other control surface (84).

10. Apparatus (10) according to claim 7 wherein said sensing means (40) includes:

(a) a shaft (42) having a bore (48) and being rotatable in response to engine speed;

(b) a piston (60) positioned within said bore (48) and being axially movable in response to rotation of said shaft (42);

(c) first passage means (50) for introducing a control fluid into said bore (48) and alternately at either end of said piston (60); and (d) second passage means (52, 58) for receiving the control fluid in said bore (48) and carrying the control signal, said piston (60) forcing the control fluid alternately from either said end into said second passage means (52, 58).

11. Apparatus (10) according to claim 10 wherein said piston (60) further includes an elongated slot (68) and said shaft (42) further includes a crosspin (66) extending into said slot (68).

12. Apparatus (10) according to claim 7 wherein said control rod (16) further includes a plurality of first teeth (82) extending radially outwardly of and axially along said control rod (16), and wherein said rotating means (70) includes:

(a) cylinder means (72, 74) for receiving the control signal;

(b) a piston (76) movable within said cylinder means (72, 74) in response to the control signal, said piston (76) having second teeth (80) engaging said first teeth (82), said control rod (16) being rotatably movable in response to movement of said piston (76); and (c) biasing means (78) for acting on said piston (76) against the control signal.

13. Apparatus (10) according to claim 7 wherein said means (32, 34, 38) for axially moving includes:

(a) first passage means (32, 34) for supplying control fluid against said control surface (25) to move axially said control rod (16); and (b) second passage means (38) for receiving the control fluid acting on said control surface (25) in response to axial movement of said control rod (16).

14. Apparatus (10) according to claim 9 wherein said means (90, 96, 98, 100) for regulating includes an axially slidable tapered piston (90).

15. Apparatus (10) according to claim 14 wherein said means (90, 96, 98, 100) for regulating further includes:

(a) first passage means (92) for supplying control fluid to act on said piston (90);

(b) a slider member (102) in engagement with the circumference of said piston (90);

(c) stylus means (110) for communicating the control fluid acting on said piston (90) around said another control surface (84), said stylus means (110) having one end (112) within said slider member (102) receiving the control fluid acting on said piston (90) and another end (118) near said another control surface (84) delivering the control fluid towards said another control surface (84), said stylus means (110) being biased towards said another control surface (84); and (d) second passage means (122) for receiving the control fluid around said another control surface (84).

16. Apparatus (10) according to claim 14 wherein said means (90, 96, 98, 100) for regulating further includes:

(a) first passage means (92) for supplying control fluid to act on said piston (90);

(b) a slider member (124) in engagement with the circumference of said piston (90);

(c) second passage means (128) for communicating the control fluid acting on said piston (90) around said another control surface (84);

(d) movable stylus means (136) for controlling the communication of the control fluid with said another control surface (84) and being in contact with said another control surface (84); and (e) third passage means (122) for receiving the control fluid around said another control surface (84).

17. Apparatus (10) according to claim 7 wherein said means (16) for automatically and preselectively controlling further includes:

(a) movable fuel rack means (26) for controlling the fuel delivery quantity; and (b) a lever (18) connected to said movable fuel rack means (26) and said control rod (16), said movable fuel rack means (26) being movable through said lever (18) in response to axial movement of said control rod (16).

* * * * *